United States Patent [19]

Tholl et al.

[11] Patent Number: 5,042,439

[45] Date of Patent: Aug. 27, 1991

[54] REMOTE, SAFE, AND SECURE OPERATIONAL CONTROL OF AN INTERNAL COMBUSTION ENGINE

[76] Inventors: Gene Tholl; Steven Tholl, both of 569 E. 2875 North, Provo, Utah 84601

[21] Appl. No.: 494,993

[22] Filed: Mar. 15, 1990

[51] Int. Cl.[5] ..... F02N 11/08

[52] U.S. Cl. ..... 123/179 B; 180/167; 290/38 C; 290/38 D

[58] Field of Search ..... 123/179 B, 179 BG, 179 R; 180/167; 290/38 C, 38 D

[56] References Cited

U.S. PATENT DOCUMENTS

| | | | |
|---|---|---|---|
| 3,054,904 | 9/1962 | Fuciarelli | 290/37 |
| 3,455,403 | 7/1969 | Hawthorne | 123/179 B |
| 3,478,730 | 11/1969 | Bucher | 123/179 |
| 3,521,076 | 7/1970 | Hayon | 290/37 |
| 3,530,846 | 9/1970 | Bean et al. | 123/179 |
| 3,553,472 | 1/1971 | Arlandson et al. | 290/38 |
| 3,577,164 | 5/1971 | Baratelli et al. | 290/38 |
| 3,603,802 | 9/1971 | Petrie | 290/37 |
| 3,604,005 | 9/1971 | Gilmore | 343/225 |
| 3,696,333 | 10/1972 | Mott | 340/52 R |
| 3,788,294 | 1/1974 | Logan | 123/179 BG |
| 3,811,049 | 5/1974 | Hildreth et al. | 290/38 |
| 3,859,540 | 1/1975 | Weiner | 290/38 |
| 4,080,537 | 3/1978 | Bucher | 290/38 R |
| 4,131,304 | 12/1978 | Wagner | 290/38 C |
| 4,236,594 | 12/1980 | Ramsperger | 180/167 |
| 4,345,554 | 8/1982 | Hildreth et al. | 123/179 BG |
| 4,392,059 | 7/1983 | Nespor | 123/179 BG |
| 4,413,261 | 11/1983 | Greenberg | 290/38 C |
| 4,446,460 | 5/1984 | Tholl et al. | 340/825.69 |
| 4,674,454 | 6/1987 | Phairr | 123/179 B |

FOREIGN PATENT DOCUMENTS

| | | | |
|---|---|---|---|
| 932846 | 8/1973 | Canada | 123/179 B |
| 438787 | 11/1935 | United Kingdom | 123/179 B |

*Primary Examiner*—Andrew M. Dolinar
*Attorney, Agent, or Firm*—Lynn G. Foster

[57] ABSTRACT

An electromechanical apparatus and method for remotely controlling operation of an internal combustion engine, the apparatus using state-of-the-art transmitting and receiving circuitry for secure sending and receiving of control command signals. Further security being provided by limiting engine operation, after starting, to an idling condition. Limiting time allowed to attempt to start an engine and to start and run the engine after generation of a control command signal. Providing control capability to terminate engine operation and actuation by the apparatus by a remote command signal.

64 Claims, 7 Drawing Sheets

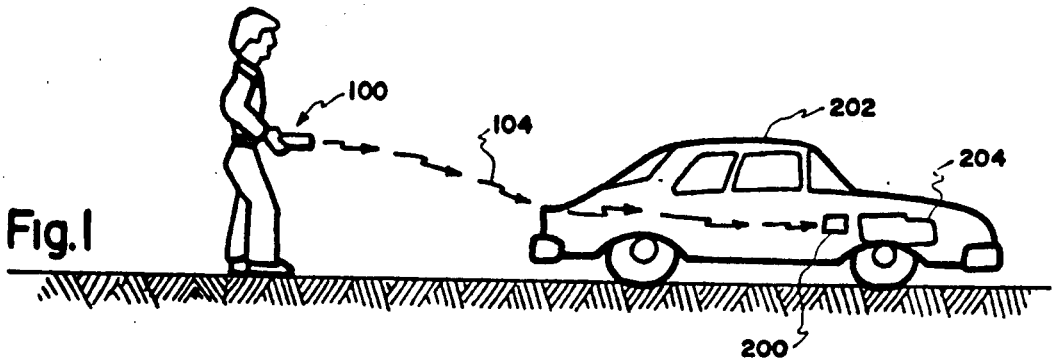
Fig. 1
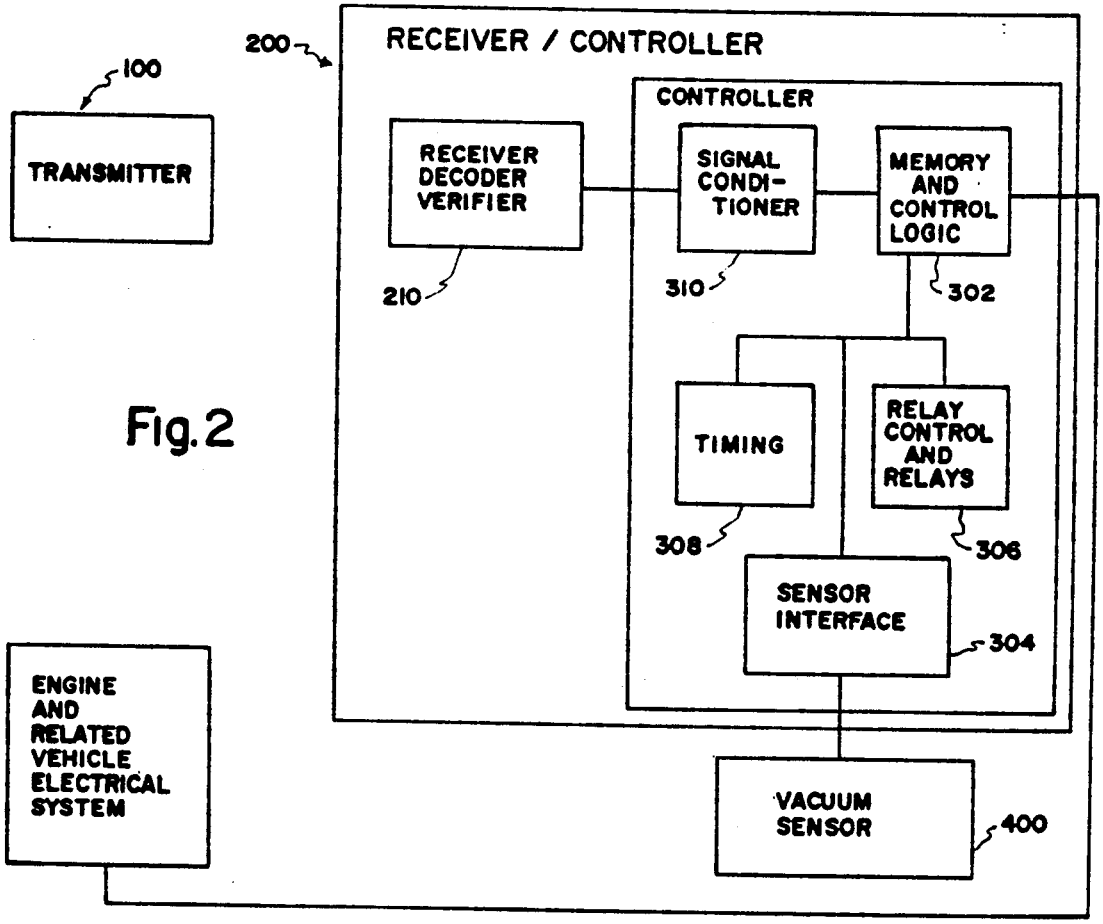
Fig. 2
| | |
|---|---|
| Fig. 3a | Fig. 3c |
| Fig. 3b | Fig. 3d |
Fig. 3

REMOTE, SAFE, AND SECURE OPERATIONAL CONTROL OF AN INTERNAL COMBUSTION ENGINE

FIELD OF THE INVENTION

This invention relates generally to internal combustion engines and more particularly to a novel device and method for safely and securely starting and stopping an internal combustion engine.

Prior Art

Known prior art for remote starting of an internal combustion engine is summarized in U.S. Pat. No. 4,446,460. Therein, early devices, proposed for remote starting of an internal combustion engine, prior to the above mentioned invention of U.S. Pat. No. 4,446,460 are described as being complex, expensive, difficult to install and posing maintenance problems. Thus, prior to the invention of U.S. Pat. No. 4,446,460 the past proposed devices are of generaly interest only. See U.S. Pat. Nos. 3,054,904; 3,455,403; 3,478,730; 3,521,076; 3,530,846; 3,553,472; 3,577,164; 3,603,802; 3,604,005; 3,696,333; 3,788,294; 3,811,049; 3,859,540; 4,080,537; and 4,131,304.

The invention of U.S. Pat. No. 4,446,460 teaches an electrical system, including apparatus and method which enables a user, at a remote location, to use a transmitter to selectively enable a receiver which in turn starts an internal combustion engine and, if desired, operates engine accessories. The enabling action includes (1) a means of actuation by a remote operator, of a switch means of supplying power to the starter of the engine, (2) a second switch means connected to receive and be energized by electrical power issuing from the first switch means, the second switch means communicating electrical power to the ignition of the engine, and (3) a means of opening the first switch means to terminate delivery of electrical power to the starter after an interval of time. Said invention also teaches the use of the first switch means to provide delivery of electrical energy to means which cause the engine throttle linkage to be displaced to choke the engine only while the starter is engaged. It further teaches the termination of power supplied to the starter, when the oil pressure has been established and sensed by a pressure sensor which is part of the system, as a means of turning off the starter when the engine is running to prevent damage to starter relay, bendex, and starter motor. A means of inhibiting operation of an associated vehicle unless the ignition key-lock has been turned to the "on" position is mentioned, but no means of enablement is specified. Said invention further teaches the use of relays and silicon controlled rectifiers for the abovementioned switch means.

The motives for remotely starting internal combustion engines comprise engine and associated vehicle warm-up in cold weather, associated vehicle cooling in hot weather, and security (such as remote starting of unsecured vehicles to test for starter and ignition triggered explosive devices). Problems not currently addressed and solved by current technology comprise security of vehicle after starting, time limiting starter cranking period for protection of starter motor and associated devices from damage and wear, time limiting remotely started operation for fuel and battery power conservation, application to vehicles requiring special drive power to engine carburetor pumps, control and operation of accessories (e.g. vehicle heater, defroster, air conditioner, and windshield wipers) only when the engine is running, and ease of installation comparable to that of this novel invention.

BRIEF SUMMARY AND OBJECTS OF THE INVENTION

In brief summary, the present invention overcomes or materially alleviates the aforesaid deficiencies of the prior art and comprises an electromechanical system, including device and methods, which enables a user, to remotely and securely command a change in an internal combustion engine's operational status. The remote command is made through a transmitter which transmits an encoded signal which is received and decoded by an associated receiver which then electrically transmits a command signal to an electromechanical controller. The transmitter and associated receiver can be selected from devices known and available in the art. The controller amplifies and conditions the received command signal from the receiver, filtering out line noise and adjusting the level of the signal to correspond to voltage levels consistent with the logic levels used in the controller. Conditioned upon the current operational state of the controller, the controller interprets the command signal to initiate an internal combustion engine start sequence or to shut down a controller-started-and electrically-powered, running engine. Also, the controller ignores a received command signal when the engine is running before the controller is activated.

When starting the engine, the controller logic provides power to the ignition then to the starter motor. If required by the engine, a carburetor pump can be driven concurrently with the starter motor. Engine operational status is provided by a vacuum sensor attached to the engine manifold. The vacuum sensor is designed to differentiate between an idling engine and one which is inoperative or accelerating or decelerating, thereby producing a measured differential pressure (between manifold and atmospheric pressures) inconsistent with an idling engine. The controller can be programmed to provide power, while the engine is idling, for selected electrical accessories, comprising the related vehicle's air conditioner, heater, defroster, and head lights. Timers are set to limit the time allowed to crank the starter and to start and run the engine following an engine start command. Electrical power is removed from the starter motor and carburetor pump when the vacuum sensor indicates the engine is idling. Further, if the engine has not idled before the time allowed to start the engine expires, the controller logic removes all power from the engine to protect against damage and wear to the starter motor, engine, battery, and related parts and the controller is reset. Also, if the time allowed to run the engine following receipt of a start command expires, the controller logic removes electrical power from the engine and the controller is reset limiting engine wear and fuel expenditure.

The key to safe and secure operation of the invention is the vacuum sensor. The vacuum sensor differentiates between engine idling and not-idling. The engine idling state is logically interpreted as the safe operational state, which, as achieved, allows the starter motor and related devices to be turned off. The engine departs from the idling state under conditions comprising engine stalling, running out of fuel, becoming inoperative, or moving the relates vehicle's accelerator. When the vacuum sensor detects these or similar conditions, it sends a signal to the controller logic which removes electrical power from the engine and resets the controller. Thus, the related vehicle may not be driven unless ignition electrical power is provided by a source other than via the controller. This restriction provides an intrinsic measure of safety and security not heretofore provided by prior art.

With foregoing in mind, it is a primary object of the present invention to provide an improved electromechanical system for and method of remotely, safely and securely starting an internal combustion engine.

A valuable object is control of ignition electrical power of an internal combustion engine independent from starter motor electrical power.

A further valuable object is provision for supplying intermittently interrupted power to drive a carburetor pump at the same time the starter motor is being driven.

A further object is remotely shutting down an engine started and electrically powered by the present invention.

A key object is the use of a vacuum sensor to determine the operational status of an internal combustion engine.

A further key object is the use of vacuum sensor to detect an idling engine from and non-idling engine.

A fundametal object is the provision of an improved system for remotely controlled operation of an internal combustion engine by a controller having one or more of the following features:

shuts off the starter motor and other devices associated with starting the motor once the engine is idling; securely removes electrical power from the engine and resets the controller when an attempt is made to drive a vehicle whose engine was started remotely without providing ignition electrical power through the use of an ignition key; uses quality commercially available transmitters and associated receivers to assure no inadvertent starting of an unselected and incorrect engine; restricts the period during which the starter motor can be cranked and other equipment related to starting the engine can be powered to prevent damage, excess wear, and battery power should the engine fail to idle within a reasonable period of time; restricts the period of time an engine will be allowed to run, once started by the system, to save fuel and reduce unwarranted engine wear; shuts off engine and removes engine electrical power to save battery power when the engine changes from an idling condition for reasons comprising stalling and running out of fuel.

BRIEF DESCRIPTION OF DRAWINGS

FIG. 1 is a schematic representation generally illustrating the concept of remote transmission of an operable command encoded and sent by a transmitter to a remote receiver/controller;

FIG. 2 is a block diagram of the transmitter, receiver, and controller system;

FIG. 3 is a diagram showing the relation between FIGS. 3*a* through 3*d*;

DETAILED DESCRIPTION OF THE ILLUSTRATED EMBODIMENT

Figure 3A:
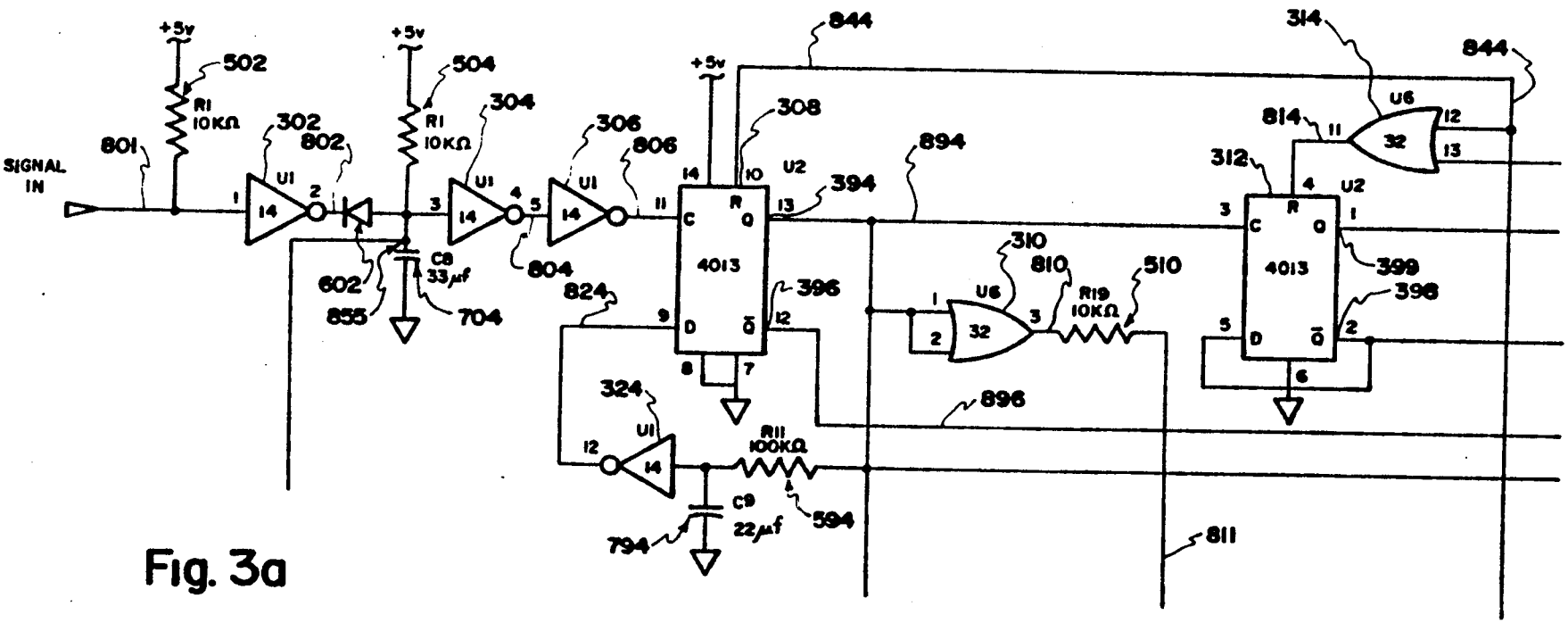
FIGS. 3*a* through 3*d* collectively comprise a circuit diagram of the controller.

Reference is made to the drawings wherein like numerals are used to designate like parts throughout and which illustrate a presently preferred electromechanical system, comprising transmitter 100 and receiver/controller 200, for remotely controlling operation of an internal combustion engine designated as engine 204. As illustrated in FIG. 1, an operator 102 at any remote position within range of the transmitter 100 and receiver/controller 200 can cause transmitter 100 to emit a command to initiate changing the operational state of engine 204, which is shown to be resident in related vehicle 202 in FIG. 1.

As seen in FIG. 2, the receiver/controller 200 is generally formed by receiver 210 and controller 300. Transmitter 100 and receiver 210 are of known and state of the art design. While the controller could accommodate command signals from transmitter/receiver combinations which have a much larger code set, those currently in use are Linear Corporations miniTransmitter, DNT00026, and associated receiver, Delta-3 DRA receiver. These provide a user selectable set of 256 different codes. Activation of transmitter 100 by operator 102 causes an encoded signal to be sent. Receiver 210 receives, decodes, and verifies each acceptable signal and, when a signal which is verified to meet the standard sent by transmitter 100 is received, forwards a command signal to the controller.

As shown in FIG. 2, the command signal is processed through a series of signal conditioning circuits 310 and sent to the memory and control logic 302 to initiate a control sequence. As will be disscussed in detail later, upon initiation of an engine 204 start sequence, the memory and control logic 302 cause timing circuits 308 to be set. The timing circuits 308 contain electronic timing mechanisms and emit a signal for a predetermined time, once activated. In the current preferred embodiment, two timing circuits are used, one which emits a signal for the maximum period allowed for the starter to crank without the motor reaching an idling state and one which emits a signal for the maximum period allowed for the motor to start and run under control of the controller before being turned off.

Under control of the memory and control logic 302, power is applied to the engine 204 and related vehicle 202 electrical system comprising starter motor, ignition, and other selected parts through relay control and relays 306. In this preferred embodiment, battery power is applied to each part through closed relay contacts as controlled by memory and control logic 302 under conditions and for periods of time to be discussed in detail later.

Engine 204 operational status is provided by vacuum sensor 400 which provides a binary signal indicating whether the engine 204 is idling or not idling. The vacuum sensor 400 output is received by the controller 300 through the sensor interface 304 which filters and conditions the signal for use by the controller 300 memory and control logic 302. Vacuum sensor 400 switching level is preset to provide a signal when the engine 204 manifold vacuum is at a preset level. In the preferred embodiment, the signal is generated when the difference between intake manifold pressure and atmospheric pressure exceeds 9.5 pounds per square inch (psi).

Reference is now made to FIG. 3, which comprises FIGS. 3*a*,3*b*,3*c* and 3*d* to review details of the preferred embodiment of controller 300. In controller 300, three kinds of logic circuits are used in controller 300, inclusive OR gates (generally designated as O XXX, where XXX is the identifying numeral in FIG. 3, and throughout the other Figures), AND gates (generally designated as A XXX), and inverting amplifiers (geneally designated as I XXX). Also D Flip-Flops (generally designated as F XXX) and a dual timer (designated TIM 328) are used. Diodes, resistors, capacitors, connecting wires, and transistor drivers shall be designated by D XXX, R XXX, C XXX, W XXX, and T XXX, respectively. Relays shall be designated REL XXX and noise suppressors denoted by MOV XXX. Connecting wires shall be referred to as W XXX. A positive voltage (normally 5 Volts DC) will be considered as a high or logical "one". Ground or a voltage below the switching voltage of a gate will be considered to be a low or logical "zero".

Input command signals are received in the form of grounding normally floating W 801, as seen in FIG. 3*a*, or causing a state transition from high to low of W 801, either of which causes I 302 to change from a conducting state to one which is non-conducting, thereby applying a high signal to W 802 which is filtered to remove high frequency noise received from the RF receiver 210 by the low pass filter formed by components D 602, R 504, and C 704. At connecting point 855, the signal may be inhibited by either or both T 354 or T 356, found in FIG. 3*b*, conducting and holding W 854 to a ground or low condition. The driving logic for T 354 and T 356 will be described later. The input command signals are further conditioned by passing them through two successive inverters I 304 and I 306 which are interconnected by W 804. The leading edge of each command signal at the output of I 306 and sent through W 806 to the clock input of F 308 is a rising signal in transition from a low to a high, a condition interpreted as the time to set F 308 to the logical state defined by the state of the signal on the data line of F 308.

The Q output at position 394 of F 308 is delivered to four logic elements along W 894, as follows:

(1) A connection is made through a delay circuit formed by R 594 and C 794 to I 324. The inverted output of I 324 is delivered through W 824 to the data line of F 308. The delay circuit formed by R 594 and C 794 causes the data line of F 308 to be in the state of the Q output at position 394 of F 308 prior to the receipt of the leading edge of each command signal, thus making F 308 operate as a triggering flip-flop and each time a leading edge of a command signal is received F 308 "triggers" to the opposite state.

Figure 3B:
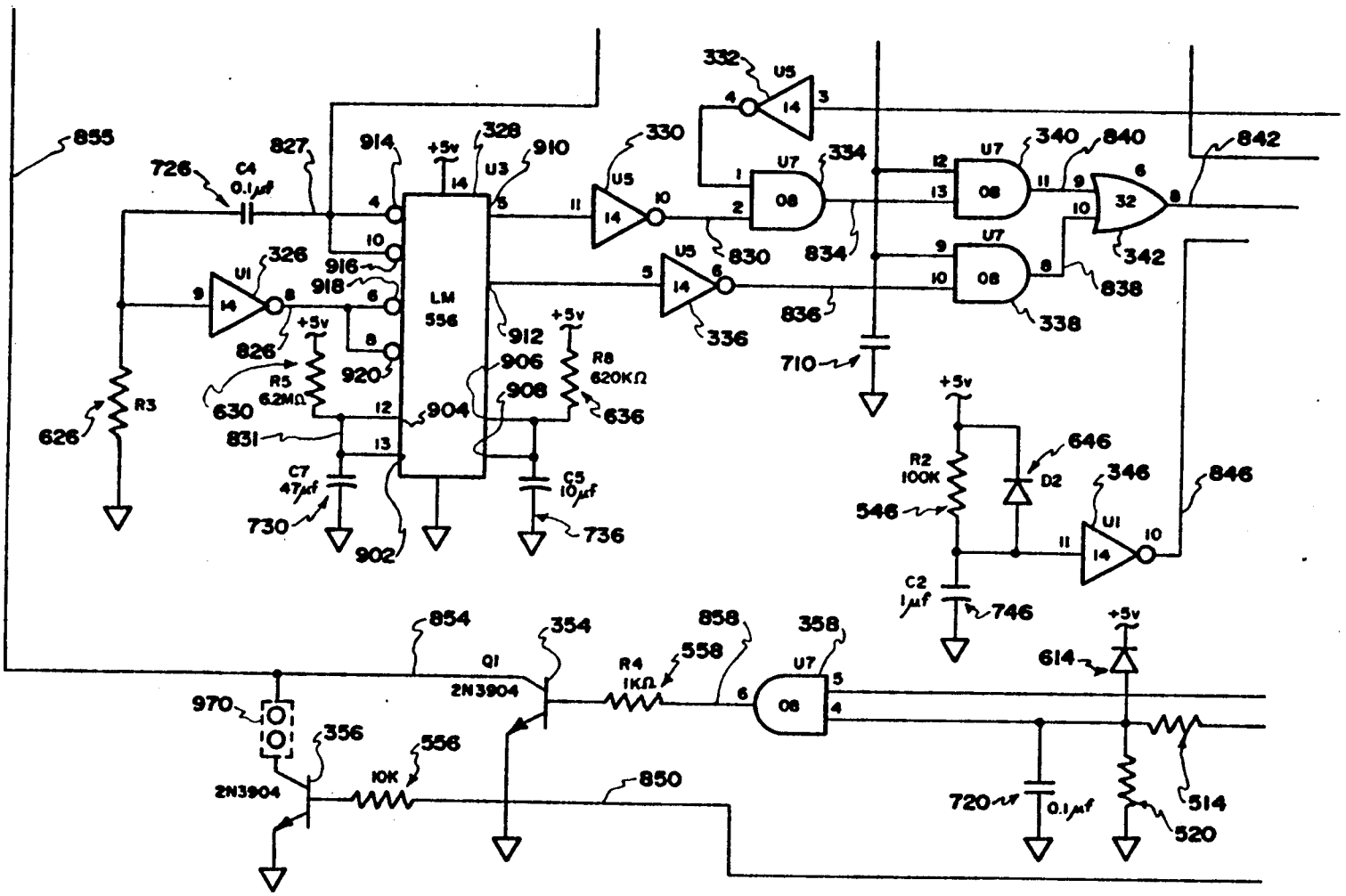

(2) As shown in FIG. 3*b*, another connection is made directly through W 894 to TIM 328 inputs 914 and 916 and through C 726 and across R 626 to I 326 to inputs 918 and 920, causing TIM 328 to set and begin emitting output timing pulses at outputs 910 and 912 when the Q output of F 308 goes high. When the Q output of F 308 goes low, TIM 328 is reset and terminates all output pulses. The length of the output pulse at output 910 sets the maximum time which be allowed to attempt to crank the starter motor and is determined by the time constant of R 636 (620 k ohms) and C 736 (10 microfarad), connected to inputs of TIM 328 at inputs 906 and 908. In the preferred mode, the time constant of R 636 and C 736 produces a pulse of 8 seconds duration. The length of the output timing pulse at output 912 sets the maximum time which will be allowed to run the engine after the controller memory is turned "on" and is determined by the time constant of R 630 (6.2 megohms) and C 730 (47 microfarad) which are connected to TIM 328 inputs 902 and 904. In the currently preferred mode, the time constant of R630 and C730 produces a pulse of 12 minutes duration.

(3) Yet another connection is an input to A 348, found in FIG. 3*c*, a gate which controls actuation of head lights and accessories, the logic of which will be described later.

(4) Connection is also made to the clock input of F 312. The Q NOT output of F 312 is directly connected to its data line, thus causing it to set, when previously unset on the leading edge of a low to high change of state of the Q output of F 308. Thus, F 312 is slaved to F 308 which, as described above, controls the "on-off" status of the controller and is therefore the controller "on" memory in this embodiment.

As mentioned earlier, operation is conditioned upon the state of the vacuum sensor 400. When the engine is idling and producing a pressure differential between intake manifold and atmospheric pressures greater than a preset value (9.5 psi in the currently preferred embodiment) normally closed switch 424, shown in FIG. 3*d*, is opened, removing ground from W 863 through switch contact output 402. R 550 is a pull-up resistor which causes the output of A 350 to be high when switch 424 is opened. C 750 provides high frequency filtering of switch noise resulting from opening or closing switch 424. Thus, when switch 424 is opened by an idling engine, a high signal is delivered to A 350 which further delivers a high signal to three gates (A 348, O 314, and T 356 through R 556), the logic of which will be discussed later.

Again referencing F 308, in FIG. 3*a*, Q NOT output at position 396 is delivered by W 896 to I 352 (see FIG. 3*d*) and A 358, shown in FIG. 3*b*. The low signal of the Q NOT output of F 308 is low when the controller "on" memory means is on, i.e. the Q output of F 308 at position 394 is high. Therefore, low signal into I 352 produces a high signal to W 852 through load resistors 552 (1 k/ohm) to the base of T 366 causing it to conduct, pulling in REL 382 and thereby closing switch 392 and applying battery voltage, derived from W 955 to connector positions 954 and 956, to connector position 952 causing power to be delivered to the related vehicle ignition. Thus, the controller "on" memory means directly controls the ignition electrical power. If the Q NOT output of F 308 at position 396 is high indicating the controller "on" memory is off, and ignition power is already being applied through an alternate means, such as via a turned key in the ignition lock, output of A 358 is high, providing a conductive voltage through R 558 to T 354 and a subsequent ground to W 854. Ignition power is detected through a combined voltage divider, high frequency and high voltage suppressor MOV 364, found in FIG. 3*d*. The voltage divider and filter is formed using D 614, R 514, R 520, and C 720, which are seen in FIG. 3*b*. Further high voltage connection is provided by suppressor MOV 364 connected between W 853 and ground. Grounding W 854, as mentioned earlier, inhibits all received command signals beyond point 855 and makes the system any initiating command signals.

Figure 3C:
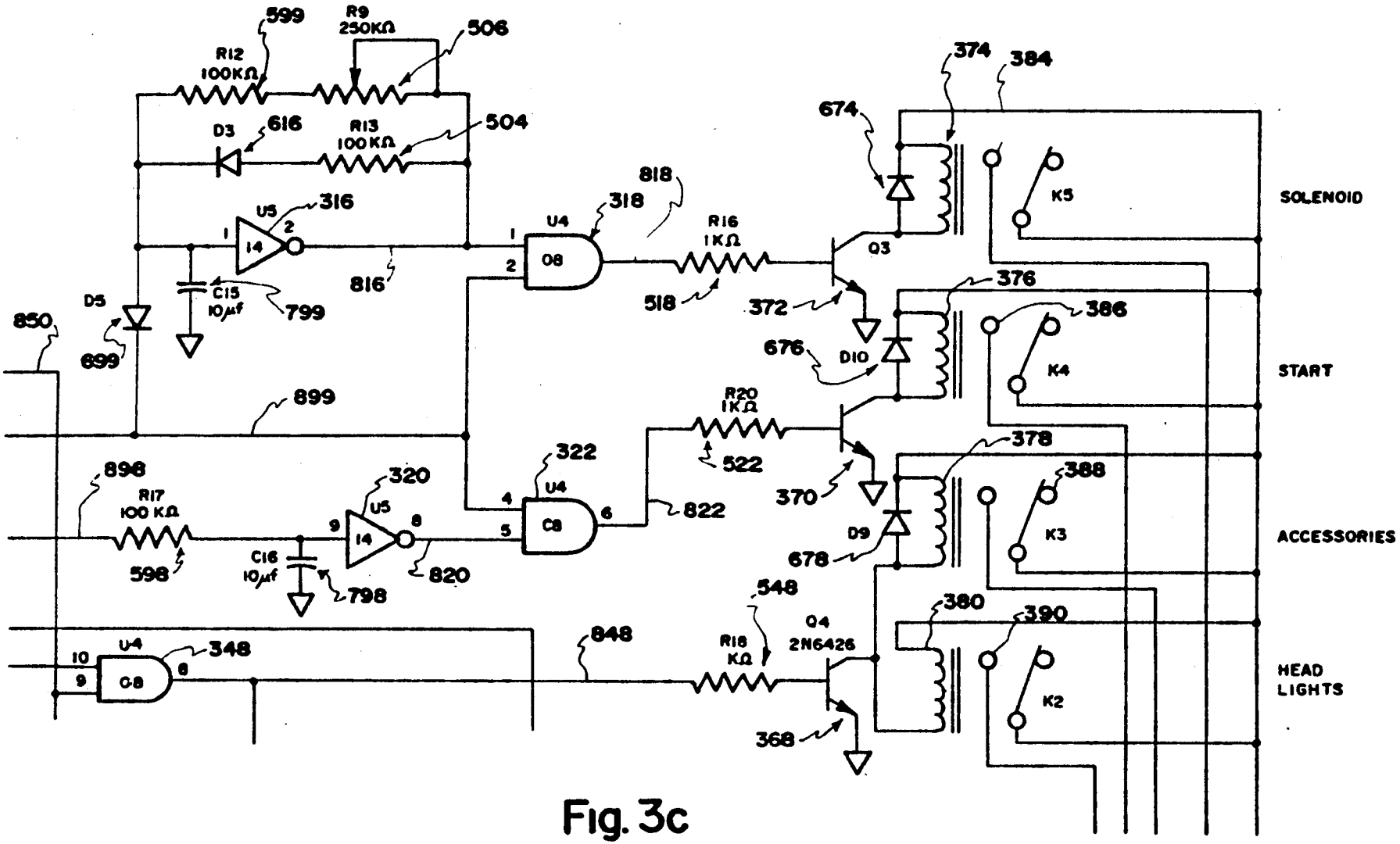
Figure 3D:
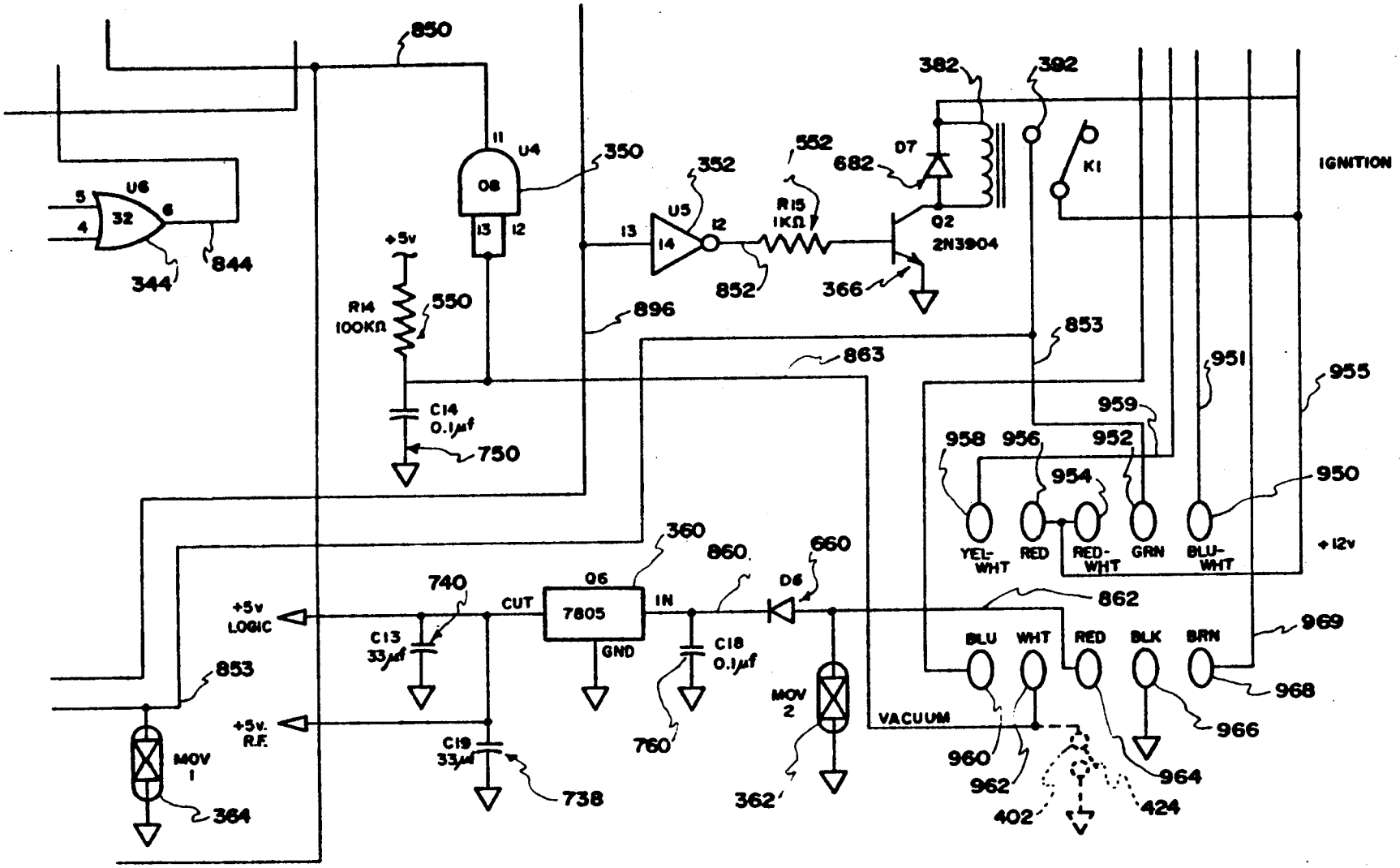

When the Q output of F 308 is high indicating the controller is "on" and the output of A 350, found in FIG. 3*d*, is high indicating the engine is idling, the output of A 348, seen in FIG. 3*c*, is delivered through W 848 and load resistor 548 (1 k ohm) to the bases of T 368 and T 370 causing them to conduct. When T 368 conducts, it pulls in REL 380, thereby closing switch 390 and applying battery voltage to connector position 960 causing power to be delivered to the related vehicle's head lights. When T 730 conducts, it pulls in REL 378, thereby closing switch 388 and applying battery voltage to connector position 950 causing power to be delivered to the related vehicle's accessories, selected from a list comprising the air conditioner, heater, and defroster.

The Q NOT output at position 398 of F 312 is delayed through R 598 and across C 798 then inverted by I 320 to provide a delayed gating input with the Q output at position 399 of F 312 through W 899 to A 322. When the outputs of I 320 and F 312 Q output at position 399 are high and delivered to inputs of A 322, found in FIG. 3*c*, through W 820 and W 899, respectively, the output of A 322 produces a high signal through W 822 connecting to load resistor 522 (1 k ohm) and then to the base of T 370 causing it to conduct and pull in REL 376 and thereby closing switch 386 and applying battery voltage, which is derived from W 955 and connector positions 954 and 956, through W 959 to connector position 958. Thus, power is delivered to the related vehicle starter motor and the starter "on" memory means directly controls the starter motor electrical power.

When the Q output at position 399 of F 312 goes high, D 699, found in FIG. 3*c*, no longer conducts and an oscillator formed by C 799 (10 microfarad), I 316, R 504 (100 K ohms), D 616, R 506 (a 250 K ohm variable resistor), and R 599 (100 k ohms) provides intermittent high/low pulses through W 816 to an input of A 318. The Q output at position 399 of F 312 and the high pulses on W 816 combine in A 318 to provide intermittent pulses through W 818 and load resistor 518 to T 372, causing REL 374 to actuate periodically, intermittently opening and closing switch 384 to apply periodically intermittent power to W 969 and to connecting pin 968 which is wired to the related vehicle's carburetor pump.

Other than by a triggering input from a command signal when the controller "on" memory means is on, the controller "on" memory means is reset via W 844 from O 344, as seen in FIG. 3*c*, which is driven high by I 346 or O 342, both of which can be found in FIG. 3*b*.

I 346 is a safety circuit designed to provide an "off" condition when power is first applied to the system. R 546, D 646, and C 746 provide circuit which produces a delayed positive voltage to I 346. During the delay, the output of I 346 is high, generating a reset signal. Once a sufficiently high voltage is achieved signalling a stable 5 V D.C. logic power and causing I 346 to conduct, the reset is removed.

O 342 is an OR circuit driven by A 340 through W 840 and A 338 through W 838.

Referring to FIG. 3*b*, A 340 signals the engine is no longer idling after the maximum period allowed to crank the starter has been expended. Conditions under which this occurs comprise engine stalling, not starting or becoming inoperative during the maximum starter cranking period, and upon engine acceleration or deceleration while the controller is singly providing ignition electrical power. Such a condition occurs when switch 424 closes after the high pulse emitted at TIM 328 terminal output 910 terminates ending the allowed starter cranking period. At that time, I 330 output goes high and remains high until TIM 328 is again set and a new maximum cranking period pulse is generated. If, while the output of I 330 is high, closed switch 424 successively drives A 350 low, A 348 low, and then I 332 high resulting in high signals being impressed upon W 832 and W 830 as inputs to A 334, the output of A 334 generates a reset signal. The reset logic of A 340 is completed when the logic level of W 811 and the output of A 334 are simultaneously high, driving the I 340 output high. The logic level of W 811 reflects the output at position 394 of F 308 through O 310, sufficiently delayed by R 510 and C 710 delay circuit to assure the leading edge of the run output pulse at output 912 of TIM 328 has arrived on W 836 so a race condition associated with the time delays in generating pulses in TIM 328 and opening of A 340 by the output of O 310 will not cause an inappropriate reset to occur.

A 338 signals the end of the maximum allowed engine "run" period under control of the controller by generating a high signal after the logic level of W 811 goes high and when TIM 328 output timing pulse at output 912 goes low, causing the output of I 336 to go high. The logic level of W 811 reflects the output at position 394 of F 308 through O 310, sufficiently delayed by R 510 and C 710 delay circuit to assure the leading edge of the run output timing pulse at output 912 of TIM 328 has arrived on W 836 so any race condition associated with a time delay in generating pulses in TIM 328 after F 308 triggers to the controller "on" state and providing a gate opening high signal on A 338 from the output of O 310 will not cause an inappropriate reset to occur.

In summary, F 308 reset occurs when the maximum allowed engine "run" time has been expended; when switch returns to the normally closed position due to events comprising engine stalling, not starting or becoming inoperative during the maximum starter cranking period, and upon engine acceleration or deceleration while the controller is singly providing ignition electrical power; and when the system is set to an intitial state as system power is turned on.

F 312 is reset either as a result of the vacuum sensor's signalling an idling engine by opening switch 424, and causing a high signal to be applied to A 350 which is connected to O 314 via W 850 or the same logic which resets F 308 delivered via W 844 to O 314 from the output of O 344. The output of O 314 is connected to the reset line of F 312 via W 814.

Optionally, jumper 970, found in FIG. 3*b*, can be shorted to inhibit command signals from the receiver 210 when the engine is idling. To accomplish this, the output of A 350, found in FIG. 3*d*, sent via W 850 through R 556 to T 356. The output of T 356 is steered through shorting connection 970 and tied commonly with the output of T 354 to point 855. Thus, when the engine is idling, all command signals are inhibited from passing point 855.

Again, referring to FIG. 3*d*, well regulated 5 V D.C. power is provided by regulator 360, a three terminal voltage regulator. Transistor suppressor 362 is tied to W 862 between input connection 964, which is connected to the realted vehicle's battery through system control switch 270 (see FIG. 5), and ground, while D 660 is connected in series between W 862 and W 860 to protect against reverse polarity. C 760, tied to the input to regulator 360, and C 740 and C 738, both tied to the output of regulator filter high frequency transients received from battery power. Regulator output provides 5 V D.C. for the controller 300 logic circuits and 5 V D.C. for the RF receiver 210. As seen in FIGS. 3*c* and 3*d*, diodes D 674, D 676, D 678, and D 682 are connected across the relay coils as inductive noise suppressors.

The connections to the related vehicles electrical systems and parts have been mentioned earlier, but are repeated in the table below for clarity and completeness. See FIGS. 3 and 6.

| Vehicle Power Connections | | |
|---|---|---|
| Connection no. (See FIG. 3d) | Connecting wire no. (See FIG. 5) | Vehicle no. and part (See FIG. 5) |
| 950 | 292 | 284 Selected accessories |
| 952 | 282 | 268 Ignition |
| 954 | 292 | 260 Battery |
| 956 | 280 | 270 System on-off switch |
| 958 | 286 | 264 Starter |
| 960 | 290 | 262 Head lights |
| 962 | 288 | 400 Vacuum switch |
| 964 | 278 | 270 System on-off switch |
| 966 | 276 | 274 Vehicle ground |
| 968 | 296 | 238 Carburetor pump |

Figure 5:
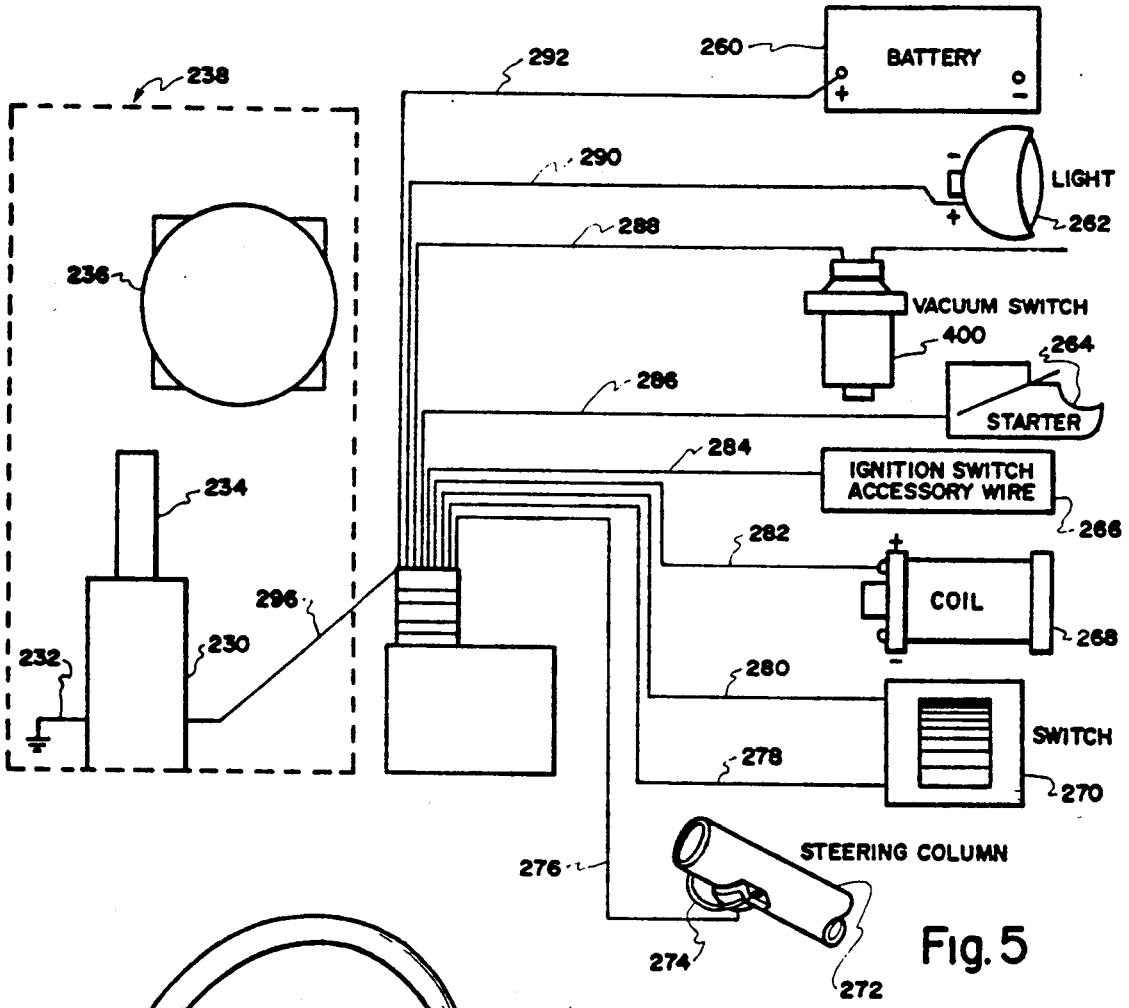
FIG. 5 is a wiring diagram showing connections to an internal combustion engine and related vehicle electrical parts.

System connections 950-968 are housed in quick disconnect electrical connector 298 for the receiver/controller 200 as shown in FIG. 5. Compatible connector 294 provides housing for the cable which connects to the related vehicle's electrical systems. Carburetor pump system comprises connection to chassis ground 232, solenoid 230, cable 234, and carburetor 236. Receiver antenna wire 294 connects to the outside of box containing receiver/controller 300. The ground attachment 274 of ground connection 966 is hard mounted to the U-clamp 274 on the steering column 272 of the related vehicle 202 as shown in FIG. 5.

Figure 6:
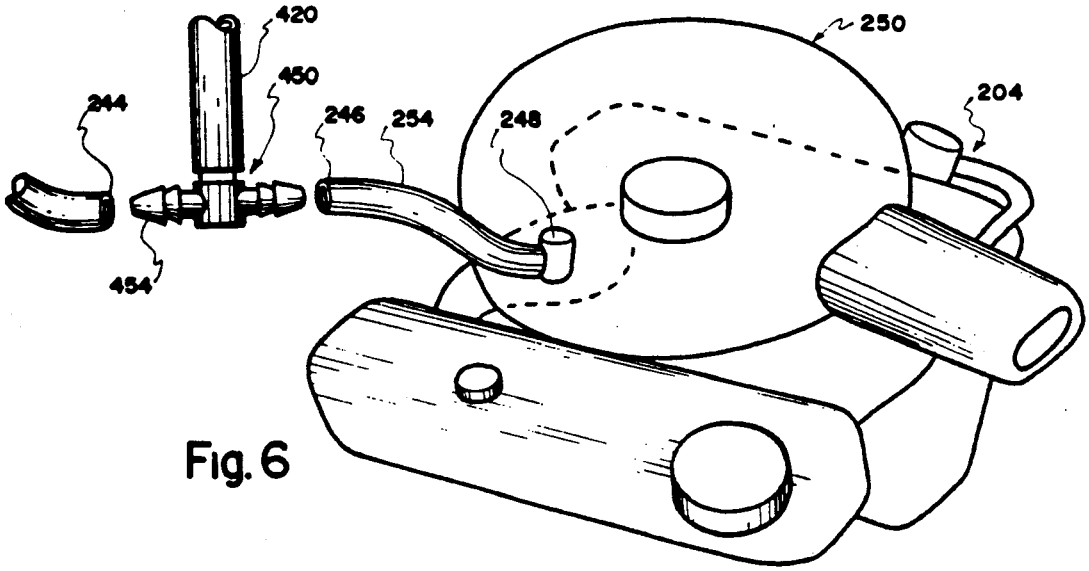
FIG. 6 is a perspective drawing showing means of acquiring manifold vacuum source for vacuum sensor.
Figure 7:
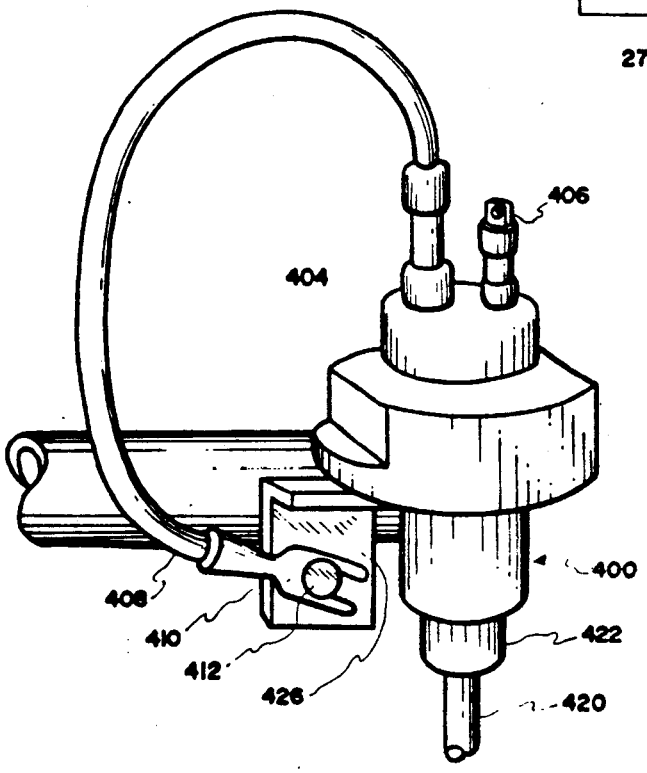
FIG. 7 is a perspective drawing of the vacuum sensor showing vacuum and electrical connections.

The simplicity of installation of the vacuum sensor 400 can be visualized by reviewing assembly and mounting procedures displayed in FIGS. 6 and 7. To install the connecting tube between manifold 250 of engine 204, find manifold 250 intake vacuum tube connection 248. At a length which will allow easy insertion of "T" connection 450, cut tube 254 revealing two ends 244 and 246. Insert opposing ends 452 and 454 of "T" connection 450 into revealed tube ends 246 and 244. Connect vacuum sensor tube connection 420 to remaining leg of "T" connection 450. The vacuum sensor 400 is mounted in a convenient position close to the manifold and away from moving parts and high heat elements of engine 204. Ground for switch 424 is provided by using bolt 412 to firmly affix ground wire 408 attached to ground wire stay 410 and mounting plate 426 to related vehicle 202 chassis. On the other end ground wire 408 is connected to vacuum sensor 400 switch contact 404. The other side of switch 424 is connected to the moving contactor 402 at connecting point 406 via W 288.

Figure 4:
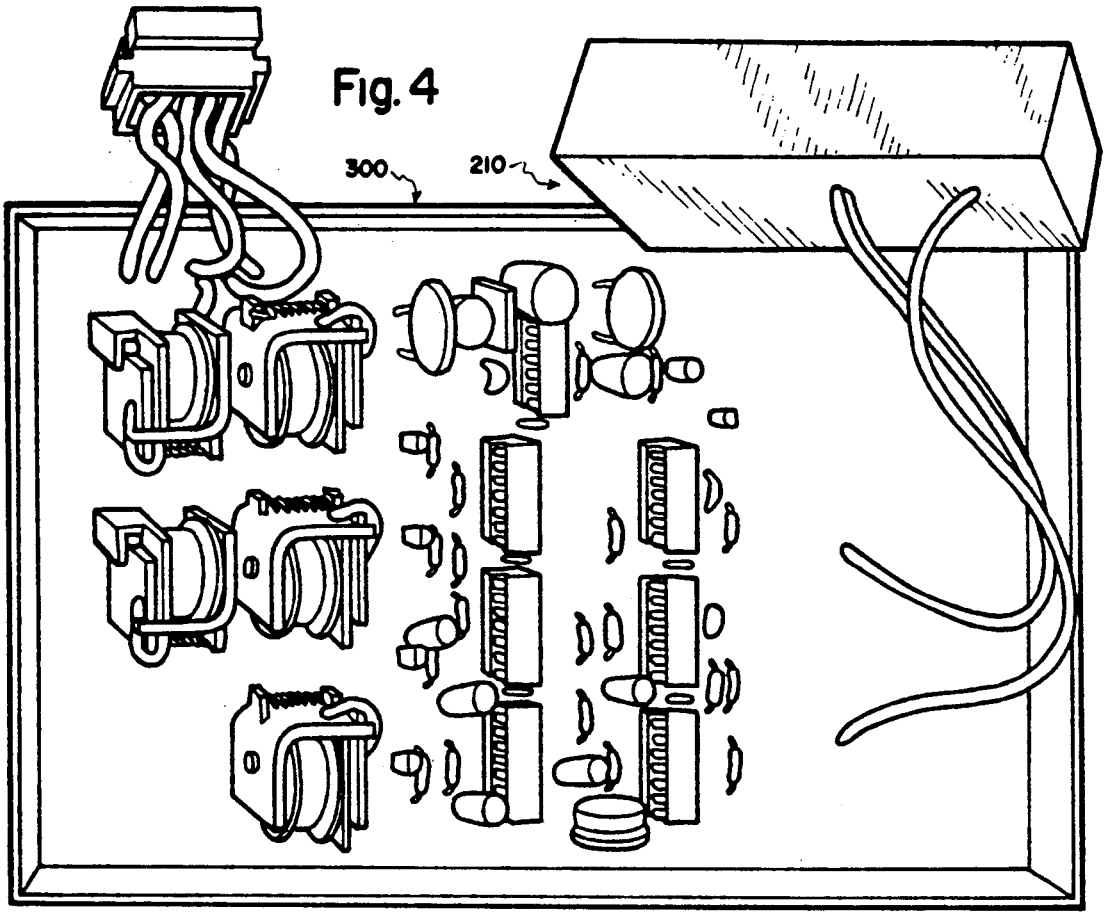
FIG. 4 is a perspective drawing of an opened controller/receiver device showing an assembly view of the controller components.

FIG. 4 is an assembly drawing showing current preferred mode component layout. The receiver 210 and controller 300 are each housed in compartments comprising one half of a 2.5 × 4.75× 6.75 inch package. Three leads (ground, power, and signal) pass from receiver 210 to controller 300. In addition, the components comprise a printed circuit board, cable and quick disconnect connector, five relays, four relay drivers, seven integrated circuits (comprising one dual D flip-flops, two packages of five inverting amplifiers, two quad packages of AND gates, one quad package of OR gates, and one dual timer), a voltage regulator, and numerous resistors capacitor, resistors, and diodes.

The invention may be embodied in other specific forms without department from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalence of the claims are therefore to be embraced therein.

What is claimed and desired to be secured by United States Letters Patent is:

1. A remote, keyless internal combustion engine starting and controlling system comprising:

vehicle means comprising:

vehicle electrical means comprising battery means, ignition means, ignition key-lock means, headlight means, and electrical accessory means;

internal combustion engine means comprising an internal combustion engine, intake manifold means, carburetor means, and starter motor means;

signal transmission means for encoding and transmitting control signals;

signal reception means which receive, decode, and verify transmitted control signals from said transmission means and which relay command signals to an interconnected engine controller means;

engine controller means comprising:

vacuum sensor means which detect and communicate operating status signals of the engine to controller logic means;

controller logic means comprising controller memory means and means which conditionally control the starting and stopping of said engine based upon received command signals, status of the controller memory means, and the operating status signals;

electrical interconnecting means comprising engine controller electrical connections to the vehicle electrical means, the vacuum sensor means, and the signal reception means;

the vacuum sensor means comprising:

vacuum attachment means which connect the fluid input of the vacuum sensor means to the intake manifold means;

vacuum sensing means which ascertain the operational status of the engine comprising means for differentiating between an idling engine and one which comprises at least one engine related operational event for which an absence of engine power is required by measuring the differential pressure between the engine's manifold pressure and atmospheric pressure and which provide a binary indication of the operational status of the engine which is communicated to the controller logic means;

the differentiating means comprising means which sense at least one of (a) a non-operational engine after a maximum cranking period, (b) a stalling engine, and (c) an accelerating engine, which, when the controller logic means are solely providing ignition electrical power, is an indication of attempted theft.

2. A remote, keyless internal combustion engine starting and controlling system according to claim 1 wherein the vacuum sensor means comprise binary indicator means which change output signal levels at a differential pressure of on the order of about 9.5 pounds per square inch.

3. A remote, keyless internal combustion engine starting and controlling system comprising:

vehicle means comprising:

vehicle electrical means comprising battery means, ignition means, ignition key-lock means, headlight means, and electrical accessory means; and internal combustion engine means comprising an internal combustion engine, intake manifold means, carburetor means and starter motor means;

signal transmission means for encoding and transmitting control signals;

signal reception means which receive, decode, and verify transmitted control signals from said transmission means and which relay command signals to an interconnected engine controller means;

engine controller means comprising:

vacuum sensor means which detect and communicate operating status signals of the engine;

controller logic means comprising controller memory means and means which conditionally control the starting and stopping of said engine based upon received command signals, status of the controller memory means, and the operating status signals;

electrical interconnecting means comprising engine controller electrical connections to the vehicle electrical means, the vacuum sensor means, and the signal reception means;

the controller memory means comprising means providing bistable storage and continuous output of the operational status of the controller logic means;

the controller logic means further comprising:

controller timing means which time the duration of predetermined time periods for uses comprising restricting starter motor cranking time and, said system controlled, engine running time;

conditional gating means which conditionally control status changes of the system and application of electrical power to vehicle electrical means;

power control means which, under control of the conditional gating means, apply and remove power from the vehicle electrical means comprising starter motor means, optional carburetor pump means, headlight means, ignition means, and electrical accessory means; and electrical harnessing and connecting means comprising connection means between the engine controller means and the battery means, the signal reception means, the vacuum sensor means, and the vehicle electrical means whereby said engine controller means can be disconnected from said electrical means for purposes comprising trouble shooting and disengagement.

4. A remote, keyless internal combustion engine starting and controlling system according to claim 3 wherein the controller memory means comprise:

controller "ON" memory means which when set to "ON" are prerequisite for ignition power to be supplied to the internal combustion engine;

starter motor "ON" memory means, which are set to "ON" by transition of controller "ON" memory means to "ON", and, when "ON", are prerequisite for power to be supplied at least to the starter motor means.

5. A remote, keyless internal combustion engine starting and controlling system according to claim 3 further comprising controller "ON" memory means and wherein the conditional gating means comprise engine start gating means which set controller "ON" memory means to the "ON" state to initiate an internal combustion engine start sequence upon receiving a command signal if none of the following conditions is true:

(a) ignition power is already being supplied to the ignition means;

(b) engine controller means are currently engaged in a start sequence;

(c) vacuum sensor means indicate engine is already idling.

6. A remote, keyless internal combustion engine starting and controlling system according to claim 3 wherein the conditional gating means comprise engine start gating means which initiate an internal combustion engine start sequence upon receiving a command signal if none of the following conditions is true:

(a) ignition power is already being supplied to the ignition means;

(b) engine controller means are currently engaged in a start sequence;

(c) vacuum sensor means indicates engine is already idling.

7. A remote, keyless internal combustion engine starting and controlling system according to claim 3 wherein the controller timing means comprise starter motor crank period means which provide a time measurement of the maximum duration a starter motor may be cranked during each start sequence.

8. A remote, keyless internal combustion engine starting and controlling system according to claim 3 wherein the controller timing means comprise starter motor crank period means which provide a time measurement on the order of about 8 seconds as the maximum duration a starter motor may be cranked during each start sequence.

9. A remote, keyless internal combustion engine starting and controlling system according to claim 3 wherein the controller timing means comprise engine run period means which provide a measurement of the maximum duration an internal combustion engine may run under continuous control of the said system.

10. A remote, keyless internal combustion engine starting and controlling system according to claim 3 wherein the controller timing means comprise engine run period means which provide a measurement of on the order of about 12 minutes which is the maximum duration an internal combustion engine may run under continuous control of the said system.

11. A remote, keyless internal combustion engine starting and controlling system according to claim 3 further comprising controller "ON" memory means and wherein the conditional gating means comprise starter motor timing means which initiate a time-out period when the controller "ON" memory mans transition to "ON", the starter motor timing means further comprising a time clock which is set at the beginning of the internal combustion engine start sequence and which determines the maximum duration allowed to unsuccessfully attempt to start said engine before the controller "ON" memory means are reset, thereby moving power supplied to the vehicle means by the power control means and shutting down the internal combustion engine.

12. A remote, keyless internal combustion engine starting and controlling system according to claim 3 further comprising controller "ON" memory means and wherein the conditional gating means comprise starter motor timing reset means which reset the controller "ON" memory means, thus aborting the start sequence and removing electrical power supplied to the vehicle electrical means by the power control means when time-out by a motor crank period means occurs before the vacuum sensor means detect and signal an idling engine has been achieved, thereby reducing damage and wear to parts comprising starter relay, bendex, and starter motor.

13. A remote, keyless internal combustion engine starting and controlling system according to claim 3 further comprising controller "ON" memory means and wherein the conditional gating means comprise internal combustion engine timing initiation means which initiate a time-out period, timed by an engine run period means, when the controller "ON" memory means transition to "ON" and, thereby, determine the maximum duration during which the engine will be allowed to run under control of the engine controller means.

14. A remote, keyless internal combustion engine starting and controlling system according to claim 3 further comprising controller "ON" memory means and wherein the conditional gating means comprise internal combustion engine timing reset means which reset the controller "ON" memory means upon expiration of the maximum duration that the internal combustion engine may run under continuous control, thereby removing electrical power supplied to the vehicle means by the power control means and shutting the engine down.

15. A remote, keyless internal combustion engine starting and controlling system according to claim 3 further comprising controller "ON" memory means and wherein conditional gating means comprise vacuum sensor reset means, said vacuum sensor reset means resetting the controller "ON" memory means when, after a signal from the vacuum sensor means has indicated said engine is idling and the maximum motor cranking period has timed out, the vacuum sensor means signalling the engine is no longer idling, a condition which comprises engine stalling, running out of fuel, and engine acceleration and which occurs when an attempt is made to accelerate said engine without electrical ignition power being supplied through the ignition key-lock.

16. A remote, keyless internal combustion engine starting and controlling system according to claim 3 further comprising controller "ON" memory means and wherein the conditional gating means comprise ignition gating means which excite ignition power control means providing ignition power while the controller "ON" memory means are "ON".

17. A remote, keyless internal combustion engine starting and controlling system according to claim 3 further comprising controller "ON" memory means and wherein the conditional gating means comprise starter motor gating means which excite starter motor power control means, from a time briefly delayed from the time the controller "ON" memory means transition to "ON" to allow ignition power to be established before power is applied to the starter motor means, throughout the rest of the time starter motor means are "ON".

18. A remote, keyless internal combustion engine starting and controlling system according to claim 3 further comprising carburetor pump means, carburetor pump power control means and starter motor "ON" memory means and wherein the conditional gating means comprise carburetor pump gating means which intermittently excite the carburetor pump power control means providing periodic excitation power while the starter motor "ON" memory means are "ON".

19. A remote, keyless internal combustion engine starting and controlling system according to claim 3 further comprising controller "ON" memory means and wherein the conditional gating means comprise termination logic means which reset the controller "ON" memory means to terminate an internal combustion engine start sequence upon receiving a command signal if neither of the following conditions is true:

(a) ignition power is already being supplied to the internal combustion engine's electrical power system;

(b) said controller "ON" memory means are set to the "OFF" state.

20. A remote, keyless internal combustion engine starting and controlling system according to claim 3 further comprising controller "ON" memory means and wherein the conditional gating means comprise headlight gating means which turn on the headlights when the controller "ON" memory means are "ON" and the engine is running.

21. A remote, keyless internal combustion engine starting and controlling system according to claim 3 further comprising controller "ON" memory means and accessory power control means and wherein the conditional gating means comprise accessory gating means which excite the accessory power control means to turn on vehicle accessories when the controller "ON" memory means are "ON" and the engine is running.

22. A remote, keyless internal combustion engine starting and controlling system according to claim 3 wherein the battery means comprise signal reception power means and engine controller power means.

23. A method for remotely, keylessly starting and controlling operation of an internal combustion engine comprising the steps of:

connecting internal combustion engine starting and controlling apparatus to an internal combustion engine;

transmit predetermined, distinctly encoded signals from a signal transmission site;

receiving, decoding, and verifying the transmitted signals at a signal reception site and communicating a command signal therefrom to an engine controller site to initiate an internal combustion engine start and control sequence;

if a sensed vacuum indicates the engine is not running, if ignition power is not being supplied through an ignition key-lock site, and if remote, keyless starting operation is not already in process, setting engine controller memory to cause ignition power to be applied to an electrical system of the engine and, then, to cause cranking power to be applied to a starter motor and to concurrently set time clocks to thereby control maximum cranking time allowed for the starter motor to crank without the engine starting and maximum running time allowed for the engine during each start and control sequence;

causing engine controller memory to terminate delivery of electrical power to the engine, shutting the engine down from a running condition when engine pressure, detected at the vacuum sensing site, indicates a pressure consistent with engine acceleration.

24. A method for remotely, keylessly starting and controlling operation of an internal combustion engine according to claim 23 further comprising the step of:

resetting engine controller memory to abort the start sequence after the starter motor has been cranked for a maximum allowed cranking time without the engine starting.

25. A method for remotely, keylessly starting and controlling operation of an internal combustion engine according to claim 23 further comprising the step of:

removing cranking power from the starter motor after the engine vacuum indicates the engine is running.

26. A method for remotely, keylessly starting and controlling operation of an internal combustion engine according to claim 23 further comprising the steps of:

applying cranking power to the starter motor thereby applying intermittent power to a carburetor pump.

27. A method for remotely, keylessly starting and controlling operation of an internal combustion engine according to claim 26 further comprising the step of:

discontinuing power to the carburetor pump after a running engine is sensed at the vacuum sensing site.

28. A method for remotely, keylessly starting and controlling operation of an internal combustion engine according to claim 23 further comprising the steps of:

resetting the memory and removing all power from the engine when a maximum allowed running time occurs before ignition power is supplied through the key-lock site.

29. A method for remotely, keylessly starting and controlling operation of an internal combustion engine according to claim 23 further comprising the step of:

removing electrical power from the engine when a stalled engine condition is sensed at the vacuum sensing site.

30. A method for remotely, keylessly starting and controlling operation of an internal combustion engine comprising the steps of:

connecting an internal combustion engine starting and controlling apparatus to an internal combustion engine;

transmitting predetermined, distinctly encoded signals from a signal transmission site;

receiving, decoding, and verifying the transmitted signals at a signal reception site and communicating a command signal therefrom to an engine controller site to initiate an internal combustion engine start and control sequence;

if a sensed vacuum indicates the engine is not running, if ignition power is not being supplied through an ignition key-lock site, and if remote, keyless starting operation is not already in process, setting engine controller memory which causes ignition power to be applied to an electrical system of the engine and, then, to cause cranking power to be applied to a starter motor and to concurrently set time clocks to thereby control maximum cranking time allowed for the starter motor to crank without the engine starting and maximum running time allowed for the engine during each start and control sequence;

resetting the engine controller memory thereby terminating deliver of electrical power to the engine when a command signal is received after the start sequence is in progress.

31. A method for remotely, keylessly starting and controlling operation of an internal combustion engine according to claim 30 further comprising the step of:

resetting engine controller memory when ignition power is being supplied through the ignition key-lock.

32. An engine controller device adapted for remotely, keylessly starting and controlling an internal combustion engine, said device comprising:

vacuum sensor means which detect and communicate operating status signals of the engine;

controller logic means comprising controller memory means and means which conditionally control the starting and stopping of the internal combustion engine based upon received command signals, status of the controller memory means and operating status signals;

electrical interconnection means comprising engine controller electrical connection means to vehicle electrical means, vacuum sensor means, and signal reception means;

the controller memory means comprising means providing bistable storage and continuous output of the operational status of the controller logic means;

the controller logic means further comprising:

controller timing means which time the duration of predetermined time periods for uses comprising restricting starter motor cranking time and, said system controlled, engine running time;

conditional gating means which conditionally control status changes of the system and application of electrical power to the vehicle electrical means;

power control means which, under control of the conditional gating means, apply and remove power from the vehicle electrical means comprising starter motor means, headlight means, ignition means, and electrical accessory means;

electrical harnessing and connecting means comprising connection means between the engine controller means and vehicle battery means, the signal reception means, the vacuum sensor means, and the vehicle electrical means whereby said engine controller means can be disconnected from said electrical means for purposes comprising trouble shooting and disengagement.

33. An engine controller device adapted for remotely, keylessly starting and controlling an internal combustion engine according to claim 32 wherein the controller memory means comprise:

controller "ON" memory means which when set to "ON" are prerequisite for ignition power to be supplied to the internal combustion engine;

starter motor "ON" memory means, which are set to "ON" by transition of controller "ON", and, when "ON", are prerequisite for power to be supplied at least to the starter motor means.

34. An engine controller device adapted for remotely, keylessly starting and controlling an internal combustion engine according to claim 32 further comprising controller "ON" memory means and wherein the conditional gating means comprise engine start gating means which set the controller "ON" memory means to an "ON" state to initiate an internal combustion engine start sequence upon receiving a command signal if none of the following conditions is true:

(a) ignition power is already being supplied to the ignition means;
(b) engine controller means are currently engaged in a start sequence;
(c) vacuum sensor means indicate engine is already idling.

35. An engine controller device adapted for remotely, keylessly starting and controlling an internal combustion engine according to claim 32 wherein the conditional gating means comprise engine start gating means which initiate an internal combustion engine start sequence upon receiving a command signal if none of the following conditions is true:

(a) ignition power is already being supplied to the ignition means;
(b) engine controller means are currently engaged in a start sequence;
(c) vacuum sensor means indicates engine is already idling.

36. An engine controller device adapted for remotely, keylessly starting and controlling an internal combustion engine according to claim 32 wherein the controller timing means comprise starter motor crank period means which provide a time measurement of the maximum duration a starter motor may be cranked during each start sequence.

37. An engine controller device adapted for remotely, keylessly starting and controlling an internal combustion engine according to claim 32 wherein the controller timing means comprise engine run period means which provide a measurement of the maximum duration an internal combustion engine may run under continuous control of the said system.

38. An engine controller device adapted for remotely, keylessly starting and controlling an internal combustion engine according to claim 32 further comprising controller "ON" memory means and starter motor crank period means and wherein the conditional gating means comprise starter motor timing initiation means which initiate a time-out period, timed by the starter motor crank period means, when the controller "ON" memory means transition to "ON", the time-out by the starter motor crank period means comprising a time clock which is set at the beginning of the internal combustion engine start sequence and which determines the maximum duration allowed to unsuccessfully attempt to start said engine before the controller "ON" memory means are reset, thereby removing power supplied to the vehicle electrical means by the power control means and shutting down the internal combustion engine.

39. An engine controller device adapted for remotely, keylessly starting and controlling an internal combustion engine according to claim 32 further comprising controller "ON" memory means and motor crank period means and wherein the conditional gating means comprise starter motor timing reset means which reset the controller "ON" memory means, thus aborting the start sequence and removing electrical power supplied to the vehicle electrical means by the power control means when time-out by the motor crank period means occurs before the vacuum sensor means detect and signal an idling engine has been achieved, thereby reducing damage and wear to parts comprising starter relay, bendex, and starter motor.

40. An engine controller device adapted for remotely, keylessly starting and controlling an internal combustion engine according to claim 32 further comprising controller "ON" memory means and engine run period means and wherein the conditional gating means comprise internal combustion engine timing initiation means which initiate a time-out period, timed by the engine run period means, when the controller "ON" memory means transition to "ON", thereby determining the maximum duration during which the engine will be allowed to run under control of the controller logic means.

41. An engine controller device adapted for remotely, keylessly starting and controlling an internal combustion engine according to claim 32 further comprising controller "ON" memory means and wherein the conditional gating means comprise internal combustion engine timing reset means which reset the controller "ON" memory means when the maximum duration the internal combustion engine may run expires, thereby removing electrical power supplied to the vehicle electrical means by the power control means and shutting down the engine.

42. An engine controller device adapted for remotely, keylessly starting and controlling an internal combustion engine according to claim 32 further comprising controller "ON" memory means and wherein the conditional gating means comprise ignition gating means which excite ignition the power control means providing ignition power while the controller "ON" memory means are "ON".

43. An engine controller device adapted for remotely, keylessly starting and controlling an internal combustion engine according to claim 32 further comprising carburetor pump power control means and starter motor "ON" memory means and wherein the conditional gating means comprise carburetor pump gating means which intermittently excite the carburetor pump power control means providing periodic excitation power while the starter motor "ON" memory means are "ON".

44. An engine controller device adapted for remotely, keylessly starting and controlling an internal combustion engine according to claim 32 further comprising controller "ON" memory means and wherein the conditional gating means comprise termination logic means which resets the controller "ON" memory means to terminate an internal combustion engine start sequence upon receiving a command signal if neither of the following conditions is true:

(a) ignition power is already being supplied to the internal combustion engine's electrical power system;
(b) said controller "ON" memory means is set to the "OFF" state.

45. An engine controller device adapted for remotely, keylessly starting and controlling an internal combustion engine according to claim 32 further comprising controller "ON" memory means and wherein the conditional gating means comprise headlight gating means which turn on the headlights when the controller "ON" memory means are "ON" and the engine is running.

46. An engine controller device adapted for remotely, keylessly starting and controlling an internal combustion engine according to claim 32, wherein:

the controller memory means comprise controller "ON" memory means which when set to "ON" are prerequisite for delivery of ignition power to the internal combustion engine; and the controller logic means further comprise conditional gating means comprising accessory gating means which excite the vehicle accessory power control means to turn on vehicle accessories when the controller "ON" memory means are "ON" and the engine is running.

47. An engine controller device adapted for remotely, keylessly starting and controlling an internal combustion engine, said device comprising:

vacuum sensor means which detect and communicate operating status signals of the engine;

controller logic means comprising controller memory means and means which conditionally control the starting and stopping of the internal combustion engine based upon received command signals, status of the controller memory means, and operating status signals;

electrical interconnecting means comprising engine controller electrical connection means to vehicle electrical means, vacuum sensor means, and signal reception means;

starter motor means;

conditional gating means;

starter motor power control means;

controller "ON" memory means;

the conditional gating means comprise starter motor gating means which excite the starter motor power control means, from a time briefly delayed from the time the controller "ON" memory means transition to "ON" to allow ignition power to be established before power is applied to the starter motor means, throughout the rest of the time the starter motor power control means are "ON".

48. A logic controller device, which conditionally controls the starting and stopping of said engine for an internal combustion engine controller means which is adapted for remotely, keylessly starting and controlling an internal combustion engine based upon received command signals, status of a controller memory means, and the internal combustion engine's operating status, the logic controller device comprising:

signal conditioning means which filter spurious noise from signals relayed from a signal reception means;

controller memory means which provide bistable storage and continuous output of the logic controller means' operational status;

controller timing means which time the duration of predetermined time periods for uses comprising restricting starter motor cranking time and, said system controlled, engine running time;

conditional gating means which conditionally control the engine controller means status changes and application of electrical power to vehicle electrical means;

power control means which, under control of the conditional gating means, apply and remove power from the internal combustion engine's electrical means comprising starter motor means, headlight means, ignition means, and electrical accessory means;

electrical harnessing and connecting means comprising connections between the engine controller means and battery means, reception means, vacuum sensor means, and the vehicle electrical means whereby the engine controller means can be disconnected from all electrical means for purposes comprising trouble shooting and disengagement.

49. A logic controller device according to claim 48 wherein the controller memory means comprise:

controller "ON" memory means which when set to "ON" are prerequisite for ignition power to be supplied to the internal combustion engine;

starter motor "ON" memory means, which are set to "ON" by transition of the controller "ON" memory means to "ON", and, when "ON", are prerequisite for power to be supplied at least to a starter motor of the engine.

50. A logic controller device according to claim 48 further comprising controller "ON" memory means and wherein the conditional gating means comprise engine start gating means which set the controller "ON" memory means to the "ON" state to initiate an internal combustion engine start sequence upon receiving a command signal if none of the following conditions is true:

(a) ignition power is already being supplied to the ignition means;

(b) an engine controller means are currently engaged in a start sequence;

(c) vacuum sensor means indicate engine is already idling.

51. A logic controller device according to claim 48 wherein the conditional gating means comprise engine start gating means which initiate an internal combustion engine start sequence upon receiving a command signal if none of the following conditions is true:

(a) ignition power is already being supplied to the ignition means;

(b) engine controller means are currently engaged in a start sequence;

(c) vacuum sensor means indicates engine is already idling.

52. A logic controller device according to claim 48 wherein the controller timing means comprise starter motor crank period means which provide a time measurement of the maximum duration a starter motor may be cranked during each start sequence.

53. A logic controller device according to claim 48 wherein the controller timing means comprise engine run period means which provide a measurement of the maximum duration an internal combustion engine may run under continuous control of the logic controller device.

54. A logic controller device according to claim 48 further comprising starter motor crank period means and controller "ON" memory means and wherein the conditional gating means comprise starter motor timing initiation means which initiate a time-out period, timed by the starter motor crank period means, when the controller "ON" memory means transition to "ON", time-out by the starter motor crank period means comprising a time clock which is set at the beginning of the internal combustion engine start sequence and which determines the maximum duration allowed to unsuccessfully attempt to start the engine before the controller "ON" memory means are reset, thereby removing power supplied to the vehicle electrical means by the power control means and shutting down the internal combustion engine.

55. A logic controller device according to claim 48 further comprising controller "ON" memory means and motor crank period means and wherein the conditional gating means comprise starter motor timing reset means which reset the controller "ON" memory means, thus aborting a start sequence and removing all electrical power supplied to the vehicle electrical means by the power control means when time-out by the motor crank period means occurs before the vacuum sensor means detect and signal that the engine is idling, thereby reducing damage and wear to parts comprising starter relay, bendex, and starter motor.

56. A logic controller device according to claim 48 further comprising controller "ON" memory means and engine run period means and wherein the conditional gating means comprise internal combustion engine timing initiation means which initiate a time-out period, timed by the engine run period means, when the controller "ON" memory means transitions to "ON", and, thereby, determine the maximum duration during which the engine will be allowed to run under control of the engine controller means.

57. A logic controller device according to claim 48 further comprising controller "ON" memory means and wherein the conditional gating means comprise internal combustion engine timing reset means which reset the controller "ON" memory means when the maximum duration an internal combustion engine may run expires, thereby removing electrical power supplied to the vehicle electrical means by the power control means and shutting down the engine.

58. A logic controller device according to claim 48 further comprising controller "ON" memory means and ignition power control means and wherein the conditional gating means comprise ignition gating means which excite the ignition power control means providing ignition power while the controller "ON" memory means are "ON".

59. A logic controller device according to claim 48 further comprising controller "ON" memory means and starter motor power control means and wherein the conditional gating means comprise starter motor gating means which excite the starter motor power control means, from a time briefly delayed from the time the controller "ON" means transition to "ON" to allow ignition power to be established before power is applied to the starter motor means, throughout the rest of the time the starter motor power control means are "ON".

60. A logic controller device according to claim 49 further comprising carburetor pump means and wherein the conditional gating means comprise carburetor pump control means which selectively provide excitation power to the carburetor pump means.

61. A logic controller device according to claim 48 further comprising controller "ON" memory means and wherein the conditional gating means comprise termination logic means which resets the controller "ON" means to terminate an internal combustion engine start sequence upon receiving a command signal if neither of the following conditions is true:

(a) ignition power is already being supplied to the internal combustion engine's electrical power system;

(b) an associated controller "ON" memory means are set to the "OFF" state.

62. A logic controller device according to claim 48 further comprising controller "ON" memory means and wherein the conditional gating means comprise headlight gating means which excite the headlights when the controller "ON" memory means is "ON" and the engine is running.

63. A logic controller device according to claim 48 further comprising controller "ON" memory means and wherein the conditional gating means comprise accessory gating means which excite accessory power control means to turn on vehicle accessories when the controller "ON" memory means are "ON" and the engine is running.

64. A method for remotely, keylessly starting and controlling operation of an internal combustion engine comprising the steps of:

connecting an internal combustion engine starting and controlling apparatus to an internal combustion engine;

transmitting predetermined, distinctly encoded signals from a signal transmission site;

receiving, decoding, and verifying the transmitted signals at a signal reception site and communicating a command signal therefrom to an engine controller site to initiate an internal combustion engine start and control sequence;

if a sensed vacuum indicates the engine is not running, if ignition power is not being supplied through an ignition key-lock site, and if remote, keyless starting operation is not already in process, setting the engine controller memory which causes the ignition power to be applied to an electrical system of the engine and, then, to cause cranking power to be applied to a starter motor and to concurrently set time clocks to thereby control maximum cranking time allowed for the starter motor to crank without the engine starting and maximum running time allowed for the engine during each start and control sequence;

turning headlights and selected accessories on from the time the engine starts until it is turned off.

* * * * *